US005472161A

United States Patent [19]

Krukovsky

[11] Patent Number: 5,472,161

[45] Date of Patent: Dec. 5, 1995

[54] PORTABLE PERSONAL WRIST SUPPORT

[76] Inventor: Yuri Krukovsky, 43 St. Mark's Pl., #6D, New York City, N.Y. 10003

[21] Appl. No.: 355,610

[22] Filed: Dec. 14, 1994

[51] Int. Cl.[6] ..... B43L 15/00

[52] U.S. Cl. ..... 248/118.5; 248/918

[58] Field of Search ..... 248/118.5, 118, 248/118.3, 118.1, 918; 400/715

[56] References Cited

U.S. PATENT DOCUMENTS

| | | | |
|---|---|---|---|
| 986,620 | 3/1911 | Ballou | 248/118.5 |
| 1,510,877 | 10/1924 | Wiedenmann | 248/118.5 |
| 4,996,977 | 3/1991 | Tiedeken | 248/118 X |
| 5,056,743 | 10/1991 | Zwar et al. | 248/118 |
| 5,158,256 | 10/1992 | Gross | 248/118.3 |
| 5,183,230 | 2/1993 | Walker | 248/118.3 X |
| 5,193,771 | 3/1993 | Hassel | 248/118.1 |
| 5,228,655 | 7/1993 | Garcia | 400/715 X |
| 5,244,296 | 9/1993 | Jensen | 400/715 |
| 5,265,835 | 11/1993 | Nash | 248/918 X |
| 5,281,001 | 1/1994 | Bergsten et al. | 297/411.24 |
| 5,335,888 | 8/1994 | Thomsen | 248/118.5 |
| 5,340,067 | 8/1994 | Martin | 248/918 X |

*Primary Examiner*—J. Franklin Foss
*Attorney, Agent, or Firm*—Robert W. J. Usher

[57] ABSTRACT

A portable personal wrist supporting device for use with a table supported keyboard is constructed of a carriage having an upper, wrist supporting face and a lower, frictionless, table engaging face, and a wrist band for securing a wrist of a keyboard operator resting on the upper face. The carriage has an above-table height between upper and lower faces such that the operator's hand will be aligned for free operative access over the entire keyboard through movement of the carriage across the table. The frictionless surface is formed by a plurality of balls mounted on the lower face. The carriage of the device is symmetrical enabling use thereof by either hand.

4 Claims, 1 Drawing Sheet

PORTABLE PERSONAL WRIST SUPPORT

FIELD OF INVENTION

The invention relates to wrist supporting devices for improving working conditions of word processors, keyboard operators or assemblymen in table-based assembly operations.

BACKGROUND OF THE INVENTION

At the present time an increasingly large number of people are spending their working hours at a word processor or computer keyboard performing thousands of repetitive actions throughout the day.

A similar forced, repetitious movement of the wrist is an every day experience for table-based assembly-line personnel manufacturing different small devices.

These working conditions can often cause repetitive strain injuries to hands or wrists of the assemblymen or keyboard operators.

Many apparatuses and systems have been developed to solve this health problem.

For example, U.S. Pat. No. 5,056,743 issued Oct. 15, 1991 to Zwar et al. teaches a system which includes a hand board and a pair of arm support pads sliding over the hand board.

However, this system requires a specially designed hand board attached to the keyboard and having a top sliding surface of polished stainless steel to provide a required low friction characteristic. In addition, the pads are freely positioned and not are not secured to the hands of the operator with the resulting risk of the hands sliding off the pads.

Another type of wrist support is taught by U.S. Pat. No. 5,158,256 issued Oct. 27, 1992 to Gross. The apparatus therein includes the assembly of a specially designed platform for supporting the keyboard and providing a guide slot so that two wrist pads received in the slot are guided for movement along with the platform.

However, the apparatus is of heavy and bulky design with a several different metal parts and requires complex adjustments during operation. Numerous moving metal parts will require servicing such as lubrication and maintenance at regular intervals. In addition, other prior systems and apparatuses include a keyboard with an elevated wrist support bar, or an arm support attached to a table or a chair.

However, all of the known prior art apparatuses are relatively bulky and expensive assemblies which still cannot accommodate really fluid and rapid motion of the hands of the operator over a keyboard with maximum efficiency and minimal fatigue and discomfort.

SUMMARY OF THE INVENTION

An object of the present invention is to provide a wrist supporting device with unrestricted mobility and which requires only minimal effort for rapid movement of the hands over a keyboard or over any area of a table, having the wrist support tied to operator's arm to prevent repetitive strain injuries to the hand of the operator.

Another object of the present invention is to provide a wrist supporting device which can be used with any known keyboard and which does not requires any additional attachments to or modifications of a keyboard.

A further object of the present invention is to provide a lightweight, inexpensive, and durable wrist supporting device which is of simple construction and does not require any maintenance.

A still further object of the present invention is to provide a portable personal wrist supporting device which need not to be shared with other operators and will improve the comfort and hygienic conditions in the working place.

A yet further object of the present invention is to provide a wrist supporting device which could have a universal application for keyboard or mouse operators or for assemblymen in a table-based assembly of small different devices.

Yet another object of the present invention is to provide the symmetrical wrist supporting device which permits use of a device of single design for both left and right hands of the operator.

According to the teaching of the present invention, there is provided a portable personal wrist supporting device for use with a table supported keyboard comprising a carriage having an upper, wrist supporting face and a lower, frictionless, table engaging face, and means for securing a wrist of a keyboard operator resting on the upper face, the carriage having an above-table height between upper and lower faces such that the operator's hand will be aligned for free operative access over the entire keyboard through movement of the carriage across the table.

In preferred embodiment, the wrist supporting device has a frictionless surface comprising a plurality of balls rotatively mounted on the lower face.

The table engaging balls of the device may have friction surfaces for avoiding a skidding action on the table.

The securing means of the device may comprise a wrist band.

The carriage of the device may be symmetrical enabling use thereof by either hand.

The wrist band permits forced rotation of the carriage about the wrist from the wrist supporting position to an inoperative position on the upper part of the wrist thereby to facilitate the performance of non-typing tasks.

More specifically, a plurality of balls on the frictionless surface of the device are assembled in a ball bearing assembly where the table engaging balls rolling on smaller balls positioned in the upper side of a hemispherical cavity receiving the table engaging balls.

The supporting device of the present invention has a number of advantages over all existed systems and apparatuses addressing this well known problem.

Traditional approaches for solving this health problem have involved assisting the arm and hand of the operator to work more effectively and with less imposed loading by improving free-standing supports, attachments to or modifications of the existing keyboard.

The present invention provides a new approach in creating a device which is attached to the arm of the operator thereby improving the functional ability of a human hand to operate in a specific working environment on already existed equipment.

Indeed, this solution provides a device which is attached directly to the hand thereby becoming an integal part of the arm of an operator during the interaction of the arm with the keyboard, mouse or with different small parts on the manufacturing assembly line.

The major advantage of the present invention is that none of the prior art devices can afford such ease of movement of the operator's arm with minimal physical stress to the operator's hand while maintaining an anatomically comfortable position of the wrist.

This advantage follows from the lightweight, portable design of the device having a ball bearing assembly which provides a minimal coefficient of friction but which does not require a specially prepared, low friction surface for operation.

None of the prior art provides a design which does not require any free-standing accessory, attachments to or modification of already existed keyboards.

None of the prior art is sufficiently portable for carrying on a person's hand forming a personal device not shared with others, which is a significant, hygienic advantage.

Another advantage is that the present device is unique in providing unlimited range of movement allowing the operator or assemblyman to access any area on the table even well behind or to the sides of the keyboard while their arms are still supported comfortably by the device.

DETAILED DESCRIPTION OF THE INVENTION

Figure 1C:
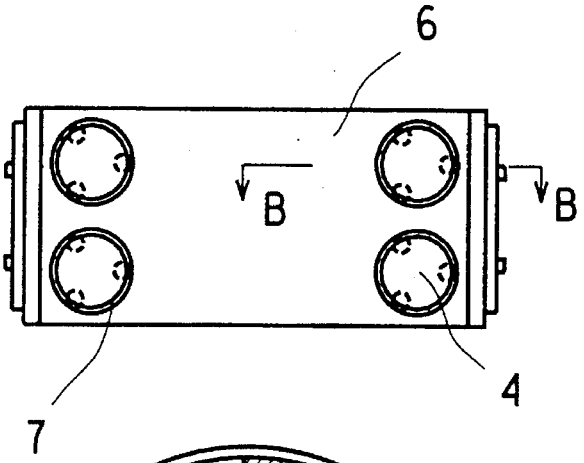
FIG. 1*a*–1*c* are, respectively, front, side and bottom views of the device with FIG. 1*a* and 1*b* partly in cross-section along lines B—B and A—A of FIG. 1*c* and 1*a*, respectively.
Figure 1A:
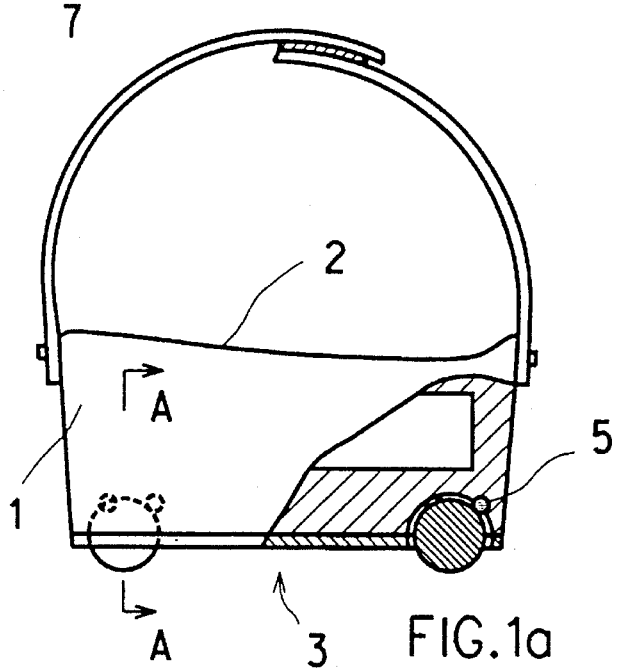
Figure 1B:
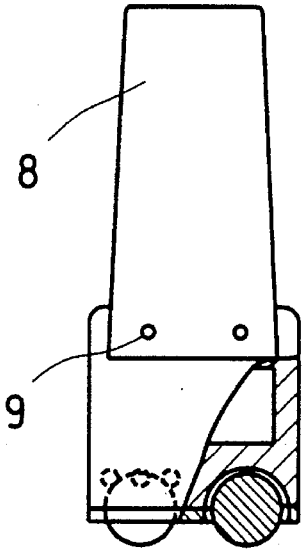
Figure 2:
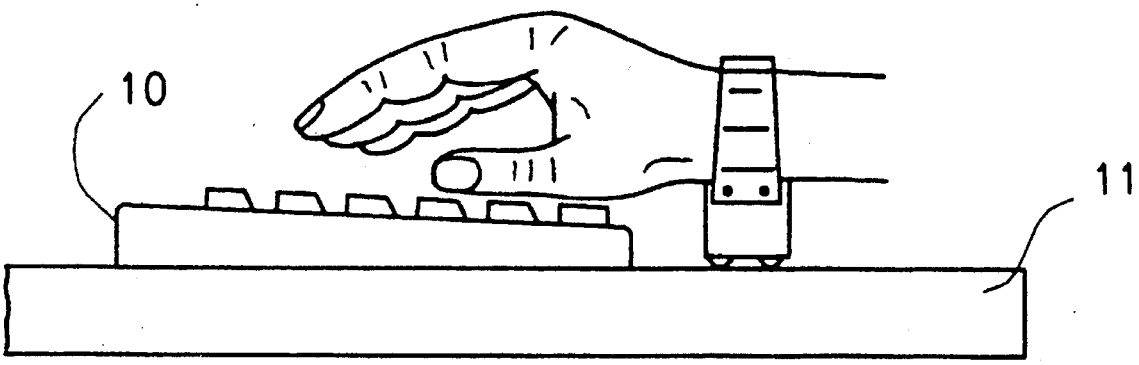
FIG. 2 is a schematic side elevation of a keyboard and a hand supported by the wrist supporting device of the present invention.

As shown in the FIG. 1 and 2, a wrist supporting device for supporting the wrist of a keyboard operator comprises a carriage 1 having an upper, wrist supporting face 2 and a lower, table engaging face 3. Four balls 4 and twelve balls 5 of a ball bearing assembly are rotatively mounted in the respective corners of the table engaging face being captured or trapped in respective cavities formed in the lower face by a rigid retaining plate 6 having undersize ball admitting apertures 7 formed in the respective corners thereof.

Each ball 4 rotates on the assembly of three small balls 5 symmetrically positioned on the upper hemisphere of each cavity formed for the table engaging balls 4. The balls 4 have friction surfaces for avoiding skidding on a supporting table 11. A coating of solid lubricant such as TEFLON (trademark) is formed on the walls of smaller cavities for the balls 5.

A wrist band 8 for releasably securing a wrist of a keyboard operator resting on the anatomically shaped upper face 2, comprises a pair of elongated strips having one of their respective ends anchored to the carriage adjacent the upper face by rivets 9, for example, and a releasible fastening material such as VELCRO (trademark) or other hook and loop type material on respective free ends thereof. Alternatively, the wrist band could be formed by a single elastic band.

The carriage has a plastic body, cavitied for lightness, which has a above-table height, as measured between upper and lower faces, such that the operator's hand will be aligned for free operating access over the entire keyboard 10 by movement of the carriage across the table. The carriage has a symmetrical design, enabling use thereof by either hand.

In use of the device, the operator simply fastens his wrists to a pair of the devices and proceeds to type with the carriages resting on the table supporting the keyboard, the balls enabling free movement of carriage and wrist across the table in front of the keyboard providing access to all area of the keyboard while maintaining support for the wrist, thereby ameliorating operator stress and fatigue.

When the operator requires to undertake another tasks he simply rotates the carriage on his wrist to an uppermost position so that it does not obstruct or otherwise impede the necessary hand movement. Thus, the device can be worn by the operator throughout the working day and remained personalized avoiding risk of infection from use by others.

In one embodiment, the body, including the balls, is approximately one and one quarter inches in height, two and one quarter inches long and one and quarter inches in depth as measured in the direction of extension of the operator's wrist.

I claim:

1. A wrist supporting device for use with a table supported keyboard comprising a carriage having an upper, wrist engaging face providing an elevated, continuous, substantially horizontal, wrist engaging surface contacting substantially only an underside of a keyboard operator's wrist in an open palm down position and a lower, table engaging face including a plurality of balls rotatively mounted thereon and wrist band means for securing the wrist with the underside resting on the upper face, the carriage having an above-table height between upper and lower faces greater than the height of a front peripheral edge of the keyboard such that when the wrist is supported on the wrist engaging face, the operator's hand will be elevated above the table aligned for free operative access over the entire keyboard through movement of the carriage across the table.

2. A wrist supporting device according to claim 1 wherein the balls have friction surfaces for avoiding a skidding action on the table.

3. A wrist supporting device for use with a table supported keyboard comprising a carriage having an upper, wrist engaging face providing an elevated, continuous, substantially horizontal, wrist engaging surface contacting substantially only an underside of a keyboard operator's wrist in an open palm down position and a lower, frictionless, table engaging face, and means for securing the wrist with the underside resting on the upper face, the carriage having an above-table height between upper and lower faces greater than the height of a front peripheral edge of the keyboard such that the operator's hand will be elevated above the table aligned for free operative access over the entire keyboard through movement of the carriage across the table.

4. A wrist supporting device for use with a table supported keyboard comprising a carriage having an upper wrist engaging face for elevating and maintaining an operator's wrist above the table extending substantially horizontally in an open, palm down position, a lower, frictionless table engaging face, and means for securing the carriage to an operator's hand, the carriage having an above table height greater than the height of a front peripheral edge of the keyboard thereby aligning the operator's hand so as to exclude any engagement of an operator's arm with any part of the table for free operative access over the entire keyboard through movement of the carriage across the table.

* * * * *